US005434388A

United States Patent [19]

Kralik et al.

[11] Patent Number: 5,434,388

[45] Date of Patent: Jul. 18, 1995

[54] ELECTRICAL HEATER FOR MEDIA, PARTICULARLY FLOW HEATER

[75] Inventors: Willi Kralik, Sulzfeld; Siegbert Berger, Karlsruhe; Franz Bogdanski, Oberderdingen; Peter Stupp, Sulzfeld; Werner Koegel, Oberderdingen, all of Germany

[73] Assignee: E.G.O. Elektro-Gerate Blanc u. Fischer, Germany

[21] Appl. No.: 132,793

[22] Filed: Oct. 7, 1993

[30] Foreign Application Priority Data

Oct. 7, 1992 [DE] Germany ..... 42 33 676.7

[51] Int. Cl.[6] ..... H05B 3/44

[52] U.S. Cl. ..... 219/538; 392/480; 219/542; 219/522; 219/535

[58] Field of Search ..... 219/538, 535, 542, 528, 219/548, 549, 522; 392/479, 480

[56] References Cited

U.S. PATENT DOCUMENTS

| | | | |
|---|---|---|---|
| 2,473,560 | 6/1949 | Bagley | 392/480 |
| 2,665,364 | 1/1954 | Thomas | 219/542 |
| 3,019,325 | 1/1962 | Clouse | 392/480 |
| 3,139,518 | 6/1964 | Gardener | 219/522 |
| 3,315,703 | 4/1967 | Matthews | 392/480 |
| 3,727,029 | 4/1973 | Chrow | 219/549 |
| 4,455,474 | 6/1984 | Jameson | 219/522 |
| 5,020,128 | 5/1991 | Bleckman | 392/498 |

FOREIGN PATENT DOCUMENTS

| | | |
|---|---|---|
| 1806721 | 5/1970 | Germany . |
| 7020539 | 9/1970 | Germany . |
| 2233503 | 1/1971 | Germany . |
| 1690677 | 6/1971 | Germany . |
| 2552625 | 6/1977 | Germany . |
| 3221348 | 12/1983 | Germany . |
| 3633759 | 4/1987 | Germany . |
| 8701656 | 4/1987 | Germany . |
| 3903649 | 4/1990 | Germany . |
| 4012643 | 12/1990 | Germany . |
| 9105855 | 2/1992 | Germany . |
| 4034611 | 5/1992 | Germany . |
| 220465 | 4/1942 | Switzerland . |

*Primary Examiner*—Teresa J. Walberg
*Attorney, Agent, or Firm*—Quarles & Brady

[57] ABSTRACT

A flow heater (11) has a stainless steel tube (1Z), around which is externally placed a polyimide (KAPTON) insulating film (14) with an overlap (15). Under pretension is wound onto the same a metallic resistance material heating tape (17), so that the resulting elasticity reserve, also at operating temperature, ensures a good application of the heating tape to the film. Temperature switching devices for preventing excess temperatures or running dry can be fitted in the overlap area (15).

24 Claims, 4 Drawing Sheets

ELECTRICAL HEATER FOR MEDIA, PARTICULARLY FLOW HEATER

FIELD OF THE INVENTION

The invention relates to an electric heater for media, such as liquids and in particular to a flow heater, which has a preferably tubular hollow body with a wall, to whose outside are applied electrical heating elements.

BACKGROUND OF THE INVENTION

Such heaters are widely used in dishwashers, coffee percolators and other apparatuses where liquids are heated. They are mainly heated by tubular heaters, which are helically soldered onto the outside thereof (DE-32 21 348 C2). Attempts have already been made to work with rectangular heating resistors, whose insulation with respect to the heater wall is provided by a metal oxide coating on the same or on the wall of the container (DE-1 690 677 A1).

Attempts have also been made in the case of a continuous heater to apply heating conductors with a rectangular cross-section in the interior of the flown through tube to a plastic inner tube (DE-22 33 503 A1). In this case the liquid is under the operating voltage, which is usually inadmissible.

It can be gathered from all these earlier attempts that a main problem is the interposing of an electrical insulation between the heating conductor and the heater wall. Attempts have been made to keep this small through a relatively unreliable metal oxide insulation or to completely omit it when the heating conductor is located on the inside. Although this problem is less with tubular heaters, because the highly compressed embedding material of the tubular heater has a relatively good heat conducting action, the tubular heater and its soldering lead to relatively high manufacturing costs. In addition, with all the earlier flow heaters problems are encountered in fitting an excess temperature protection device and the response behaviour thereof is not good, unless extra costs are involved.

SUMMARY OF THE INVENTION

Primary object of the invention is therefore to provide an electric heater, which avoids the disadvantages of the prior art and which in particular can be manufactured in a simple and inexpensive manner, while being improved with respect to the heat transfer and the fitability of temperature switches.

According to the invention this object is achieved in that a foil or film-like electrical insulation is provided between the hollow body wall and the heating element.

This insulation can comprise a plastic film or sheet, preferably of high temperature-resistant polyimide. It can be placed in the form of one or optionally a few layers round the wall and can in particular be overlappingly wound around the same. Although such an insulation could also consist of film strips wound helically round the hollow body, it has been found that a leaf-like film or sheet is preferable with respect to the dielectric strength, which takes up the entire length of the heated area and overlapped in an axial longitudinal zone of the hollow body. Despite the resulting asymmetry over the circumference and an increased heat transfer resistance between the heating element and the hollow body in the vicinity of the overlap, no disadvantages have been detected with regards to the characteristics and stability. On the contrary, the overlap area was particularly suitable for the fitting of a thermostat, because in this area the highest temperatures certainly occur (detected on the outside of the heater) and a direct coupling of a thermostat with the heating can be obtained.

The heating element can be an insulated, metallic heating conductor tape, which is helically wound onto the insulation. This takes place directly, but if necessary an adhesive can be interposed.

It would be expected that as a result of the temperature differences occurring between the hollow body and the heating element and optionally as a result of material differences it would not be possible to permanently maintain a good pressing of the heating element onto the insulation and therefore a good heat transfer. However, in the invention means can be provided which prevent such a temperature-caused expansion difference in operation between the wall and the heating element and maintain the application of the latter to the wall. It is particularly preferred to wind the heating element onto the insulation on the hollow body under a pretension such that there is an elasticity reserve, which ensures a constant engagement in the operating temperature range. Instead of or in addition to this can be provided by a corresponding choice of materials, in that e.g. the heating element is given a lower specific temperature expansion than the heating body, so that even an excess temperature of the heating element with respect to the hollow body leads to no significant expansion difference between the two.

The heating element can comprise a flat strip or tape of metallic resistance material, whose flat sides engage on the insulation. The tape thickness should be smaller than 1/6 and preferably smaller than 1/20 of the width. The thickness is preferably 0.05 to 0.15 mm, while the width is preferably 1 to 5 mm. Suitable as the resistance material are all conventional iron-based materials, e.g. a chrome-aluminium-iron alloy, such as is known under the trade name Kanthal AF or a nickel-chrome-iron alloy, known under the trade name Kanthal Nicrothal.

Around the heating element can be applied an external insulation constituted by a plastic film, such as is also used for the insulation between the heating element and the hollow body. This plastic film for the internal and external insulation preferably consists of a high temperature-resistant polyimide, known under the trade name Kapton. Use should be made of a film having a thermal conductivity below 0.5 W/mK. The high dielectric strength should exceed 1250 V, which can be achieved with a thickness between 0 and 100 $\mu$m. It is then possible to place over the external insulation a metallic, e.g. sheet metal outer jacket, which can also be wound as a helical tape.

In order to protect the connection areas of the heating element against excess temperatures, it is possible to multiply duplicate the same, in that e.g. a projecting area of the end is bent back and can be firmly connected to the end region by corresponding deformation.

Particularly for said heater, but also for other purposes, it is appropriate to use a temperature switching or regulating device, which is connected to two, e.g. series-connected portions of the heating element heating the heater, which have different resistor temperature characteristics. It is possible to use a combination of PTC and NTC (positive and negative temperature characteristics) or materials with different PTC or NTC values. Switching takes place as a function of the conductivity differences which exist between the two portions on heating. They give rise to voltage or current differences, which can be supplied without any significant preparation to corresponding switching elements, such as e.g. an excess temperature relay.

It is also possible to subdivide the heating element into two portions, which can be made from the same material and which are connected to a solder melting in accordance with the given disconnection excess temperature. The solder melts at an excess temperature and puts the heating element out of operation. As such an excess temperature usually indicates a serious fault on the appliance, it is desirable for a reconnection only to take place following inspection and repair to the implement. It is also advantageous to use a temperature switching device, which operates with the thermal expansion of the heater with respect to a reference bar.

It is also possible to construct the heating element from a hollow body, e.g. a thin, metallic capillary tube, which contains an expansion fluid and which cooperates with a corresponding switching or regulating device, which is e.g. operated by an expansion element, which is connected to the capillary tube. Thus, in this case the sensor, namely the capillary tube, is simultaneously the heating element, which ensures particularly direct access to the temperature.

The invention leads to a heater, which as a simple and compact construction. Through a corresponding arrangement of the heating element, particularly in the form of a flat tape, it is possible to ensure an almost continuous heating of the medium-carrying tube, so that hotter or colder zones do not form on the inside and which must be avoided due to the deposition of materials on the inside. Manufacture can be substantially automated. Through embedding in a plastic film or sheet the heater is substantially insensitive to moisture.

It has been found that there is no justification for the objections which existed due to the thermal stability in conjunction with the excessive thermal insulation due to the very small thickness of the insulating film. Even in the overlap area, where the insulating film is in part twice as thick as in the other areas, there is no risk of the heating element overheating. This can in part be due to the fact that also within the heating tape there is a heat dissipation to the more strongly coupled sides.

BRIEF DESCRIPTION OF THE INVENTION

These and further features can be gathered from the claims, description and drawings and the individual features, both singly and in the form of subcombinations, can be put into effect in an embodiment of the invention and in other fields and represent advantageous, independently protectable constructions for which protection is hereby claimed. Embodiments of the invention are described in greater detail hereinafter relative to the attached drawings, wherein show:

FIGS. 1–2 A side and plan view of a flow heater.

FIG. 3 A not to scale detail section, e.g. along line III of FIG. 1.

FIG. 4 A roughly scale, but significantly enlarged, corresponding section through another embodiment.

FIGS. 5 to 7 Embodiments of a connection area in the partial cross-section (on a much larger scale).

FIGS. 8 & 9 Two circuit diagrams of embodiments of a temperature switching device.

FIG. 10 A plan view of an end region of the heating of a flow heater with an excess temperature protection device.

FIGS. 11 & 12 Sections along line XI-XII in the closed and opened state of the switch.

FIG. 13 A section along line XIII in FIG. 10.

DETAILED DESCRIPTION OF THE PREFERRED EMBODIMENTS

Figure 1:
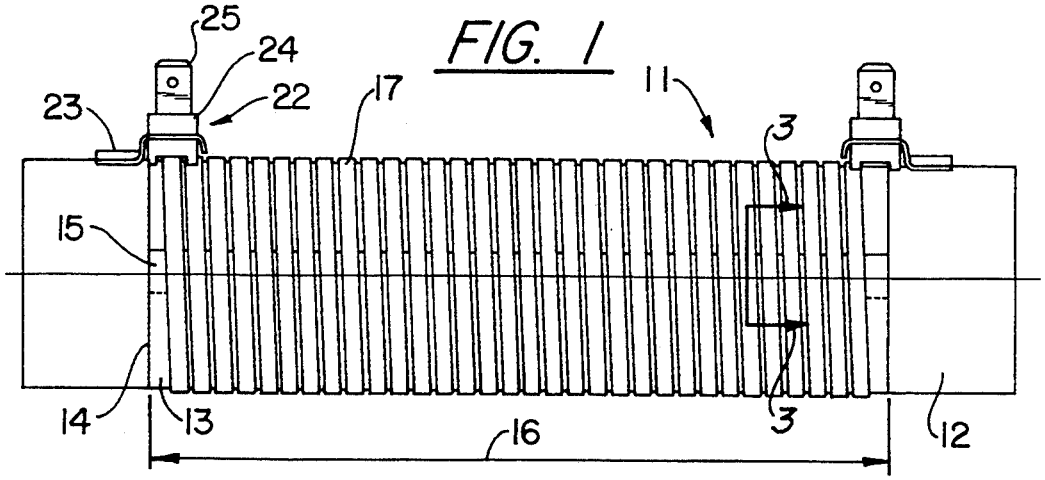

FIG. 1 shows a flow heater 11, which cain be used in washing machines, water heaters and optionally also as a steam generator for beverage preparation machines and the like. It can in general terms be used as an electric heater for media, particularly liquid media. It has a tubular body 12, in the represented embodiment a stainless steel, circular cylindrical tube, whose two open ends can be connected to a water supply and drain and through which can flow the medium to be heated, i.e. water or some other liquid, under a thermosiphon or forced flow. The inner and outer walls are smooth and without any rib or corrugation effects. This is important both for the flow resistance and for the fact that any substances precipitated from the liquids to be heated do not form a coating on the inside. The tube can have a relatively thin wall, e.g. a thickness of 1 mm. As a result of the inventive design which is as yet to be described the tube diameters are not restricted either upwards or downwards, such as would e.g. be the case when using tubular heaters as the heating element due to the minimum bending radii.

Around the outside of the wall 30 of the hollow body 12 is placed an insulation 13, as a result of the fact that a leaf-like plastic film 14 is placed round the hollow body, which overlaps in an overlap area 15, which can be between 3 and 30 mm wide. The film 74 has a width which is somewhat greater than that of the heated areas 16 (FIG. 1), so that in the longitudinal region there are no joints or overlaps of the film.

The film is of polyimide, e.g. such as that available under the trade name KAPTON. This material has a thermal conductivity of more than 0.1 W/m K and with a thickness of 20 to 100 $\mu$m has a high dielectric strength of more than 1250 V over at least one minute and namely also under higher temperatures. The thermal stability in permanent operation is 200° C. (approximately 470 K) and briefly 400° C. (approximately 670 K).

Onto the insulation 13 is wound a heating element 17, which is constituted by a tape with a width of e.g. 1 to 2 mm and a thickness of 5 to 150 $\mu$m. It can be constituted by standard, iron-containing heating conductor materials, e.g. a chrome -aluminium -iron alloy commercially available under the name KANTHAL AF, or a nickel-chrome-iron alloy (NICROTHAL 40+, 60+ or 80+, as a function of the nickel proportion).

This very thin, but relatively wide, strip-like heating element is wound onto the film insulation 13 under a pretension such that there is a very intimate pressing effect and an elasticity reserve is left behind, which in the operating state maintains this pressing effect even when account is taken of the expansion differences. As far as possible this should also exist under overheating conditions.

Figure 2:
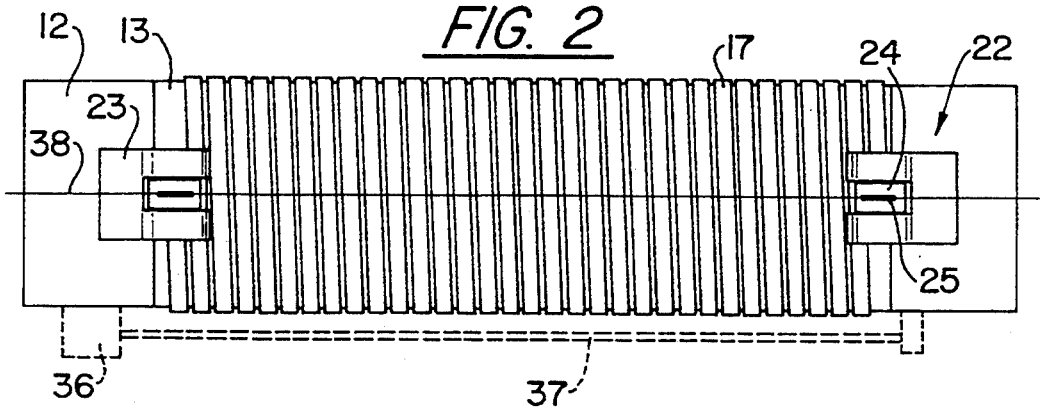

As can be gathered from FIGS. 1 and 2, the heating element 10 is helically wound around the hollow body at intervals which are significantly smaller than the heating element width, so that the hollow body wall is heated almost continuously and even when taking account of the limited thermal transverse conductivity of stainless steel no temperature differences occur in the flow direction on the inside.

Figure 3:
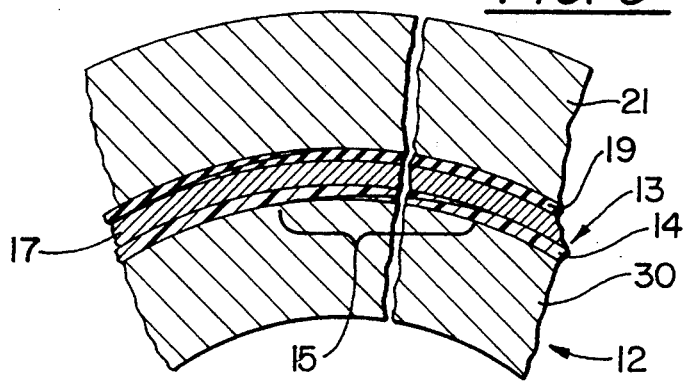
Figure 4:
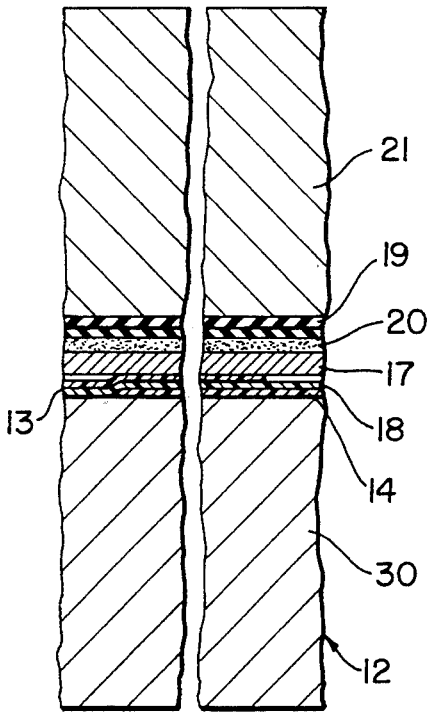

FIG. 3 shows that the insulation in the overlap area 15 is thicker than in the other areas. However, as stated, this is in fact desirable. However, if necessary, it can be reduced in that, as shown in FIG. 4, use is made of a correspondingly thinner plastic film 14, which is wound in multilayer manner. With the double winding shown, the overlap area 15 is only 508 thicker than the remaining insulation area. In addition, in this embodiment use is made of an adhesive 18, which fixes the film to the hollow body wall 12 and fills any gaps. With the elasticity of the plastic film, even without the adhesive there are no heat transfer-disturbing gaps or cavities. The adhesive is a high temperature-resistant silicone adhesive. In FIGS. 3 and 4 the outside of the heating tape, unlike in FIGS. 1 and 2, is additionally provided with an external insulation 19, which is constructed in the same way and with the same materials, i.e. the plastic film 14, as the internal insulation 13. It is ensured that the overlap zone of the external insulation does not coincide with the overlap zone 15 of the internal insulation, so as to ensure that there is no overheating of the heating tape at this point. In FIG. 4 an adhesive coating 20, which is materially similar to the adhesive coating 18 is provided between the heating element 10 and the external insulation 19. FIGS. 3 and 4 show that in this embodiment a metallic outer jacket 21 is placed round the external insulation. It can either be a helically wound band or a sleeve-like sheet metal jacket, whose wall thickness is roughly the same as the hollow body wall thickness (approximately 1 mm) and which contributes to the heat distribution, also with respect to the overlap areas, as well as to a possibly desired increase in the heat capacity. This external jacket can be earthed. As shown in FIGS. 1 and 2, if the conditions make it possible the heating element can be used without an external insulation and outer jacket.

Figure 5:
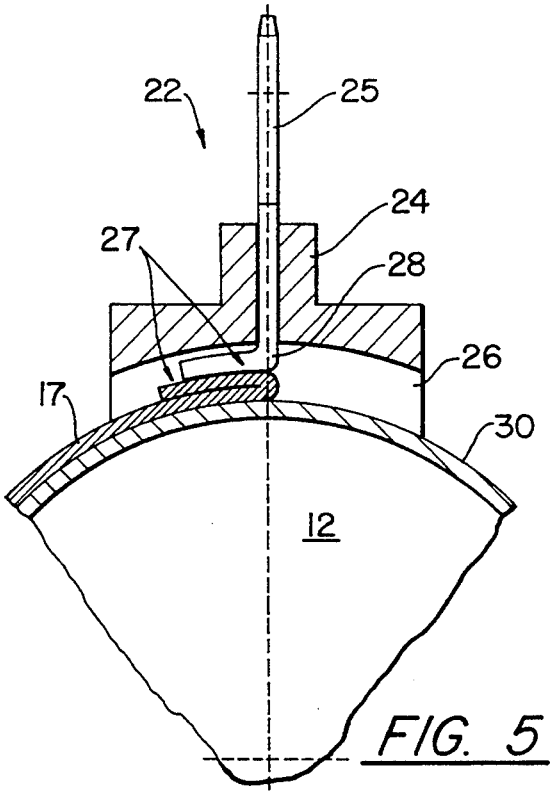

FIGS. 1 and 2 show the connections or terminals 22 provided at both ends of the helical heating element. By means of a retaining member 23 spot-applied to the hollow body 12 a T-shaped connecting member 24 is secured, which is made from thermally stable insulating material. A plain connector 25 passes through its middle leg (cf. FIGS. 5 to 7) and onto its free end projecting from the insulating member can be engaged an electric attachment plug. The bar of the inverted T-shaped connecting member is adapted with regards to its external shape to the hollow body curvature and has a channel 26 in which is located the connection with the tape-like heating element 17. This connecting area 27 is in FIG. 5 constructed in such a way that, in order to keep the connecting area cool, the heating tape is placed back round its end and is welded to a correspondingly bent end 28 of the plain connector. As a result there is a reduction in the resistance and correspondingly the thermal loading of the connection point (FIG. 5).

Figure 6:
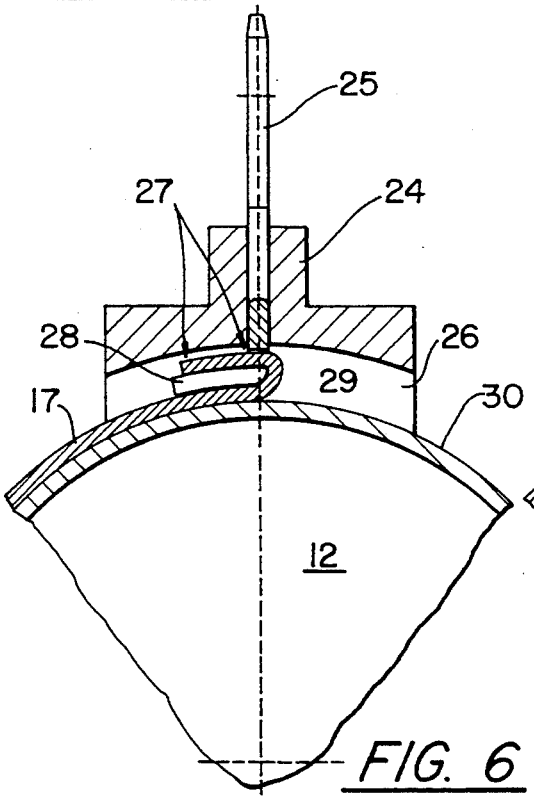

FIG. 6 shows a construction, in which in the transition between the straight portion and the bent end 28 of the plain connector 25 a slit 29 is provided, through which is engaged the bent back heating element end and is then welded to the end 28.

Figure 7:
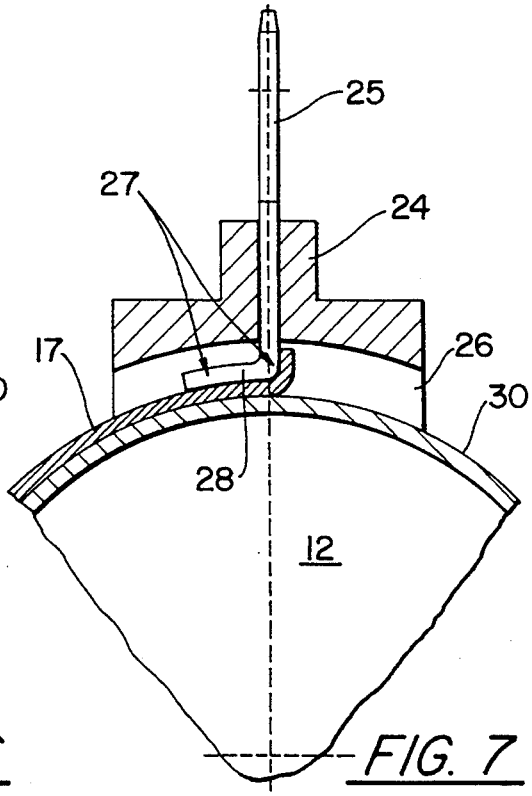

FIG. 7 shows a connection construction in which the welding of the heating element end to the bend end 28 takes place without any doubling of the heating element, but the heating tape is bent outwards and is also connected to part of the radially outwardly directed portion of the plain connector 25. As a function of the loading of the heating tape this construction can be adequate, because the plain connector ensures a good dissipation.

A heater constructed in this way ensures an ideal, full-surface, uniform heating of the hollow body inner wall transferring the heat to the medium. In the case of a surface power density of 20 $W/cm^2$, there is a temperature jump of max 70 K between the heating element and hollow body wall temperature. The heating element is kept taut and pretensioned by its fixing in the connections 22. The pretension imparted to it is in the elastic expansion range, so that with the temperatures expected no decrease in the elasticity reserve is likely, at least at the operating temperature, plus a safety supplement.

Figure 8:
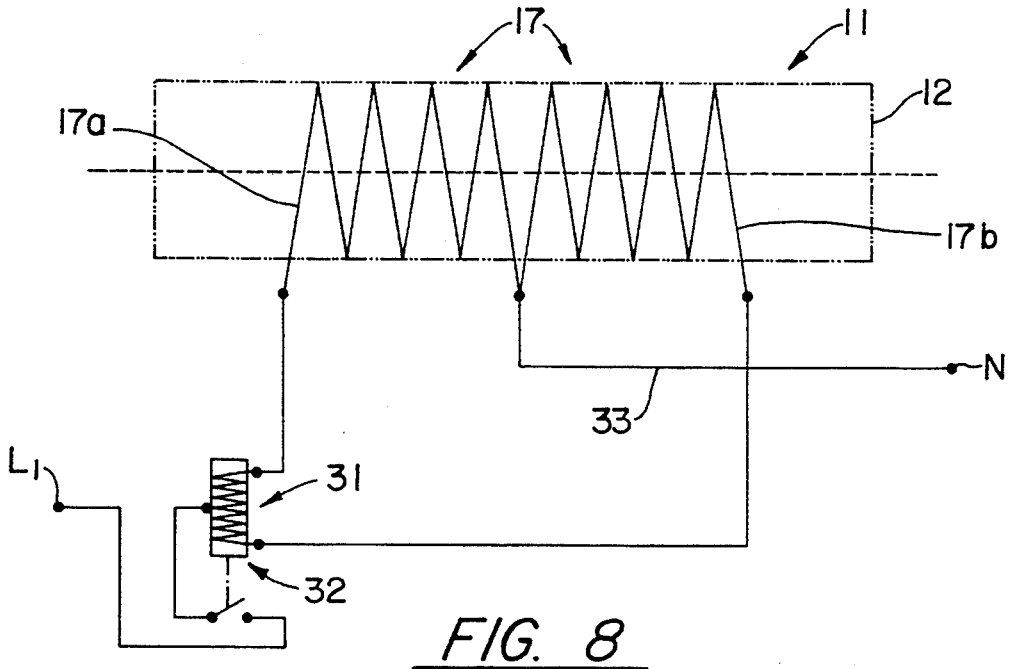

As in the case of all flow heaters, it is important to provide protection against excessive temperatures and particularly against running dry. According to the invention this can be achieved by different measures. FIG. 8 is a circuit diagram of a construction in which the heating element 10 is subdivided into two interconnected portions 17*a*, 17*b*. They are made from resistance materials having a different temperature characteristic of the resistor. They can both have a positive or negative behaviour of the resistance coefficient (PTC or NTC), these then having varying levels, or it is possible to have a combination of PTC and NTC, or use a substantially temperature-neutral material. In the embodiment the resistance value of the heating element portion 17*a* at ambient temperature is the same as that of the portion 17*b*. The two outer ends of the heating element portions 17*a*, 17*b* are applied across a trip coil 31 of a temperature switching device 32 constructed as a relay to a mains lead L1, while a line 33 applied as a centre tap between the two heating element portions 17*a* is connected to the mains pole N. On heating the two resistance values vary in such a way that with a corresponding opposite winding of the parts of the trip coil associated with the portions 17*a* and 17*b* there is a powerful disconnection pulse, which does not occur in a lower temperature range due to the opposing action of the two excitation coil halves. Thus, this leads to an uncomplicated, operationally reliable and inexpensive possibility for providing protection against excessive temperatures and in particular running dry ( lack of the medium to be heated). The relay is preferably constructed with a locking effect, so that it cannot be automatically connected in following disconnection. Only after the cause of the trip has been eliminated must it be manually rendered reoperable.

Figure 9:
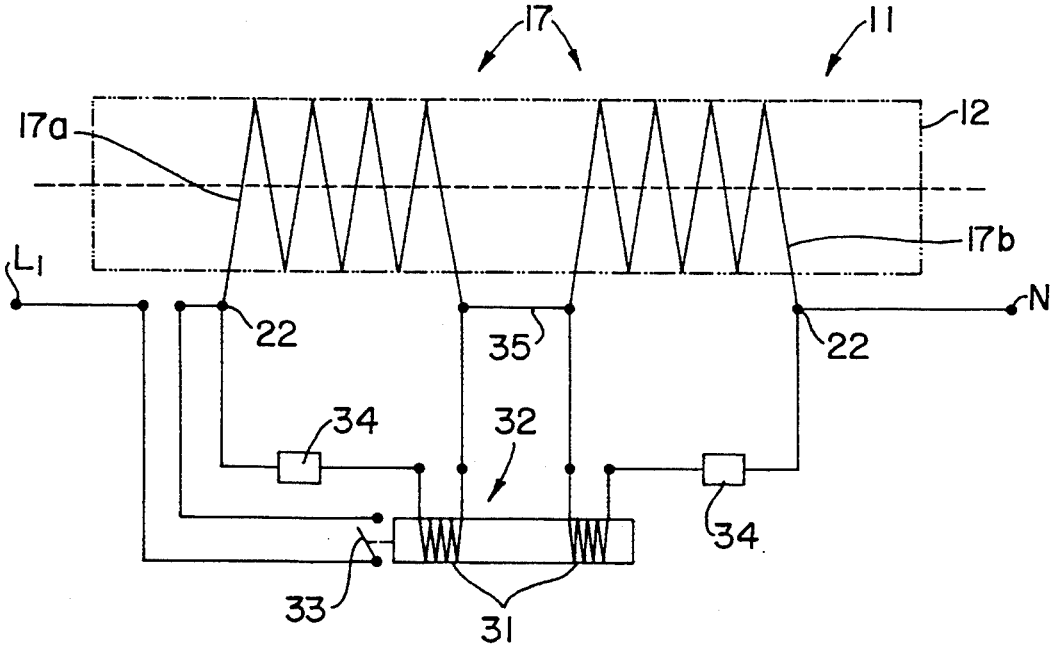

FIG. 9 shows a circuit diagram of a construction where, with otherwise identical requirements for the two heating element portions 17*a*, 17*b*, the relay, with oppositely wound excitation coils 31 and locking, is not flown-through by the total heating element current and is instead voltage-operated. In this case the two mains leads L1 and N (L1 across the switching contact 33 of the relay) are directly applied to the connections 22, whereof one is passed in each case via a line 35 leading to a resistor 34 to one excitation coil half, while the other ends of both excitation coil halves are connected to the centre tap 35. Although this construction requires additional lines or leads, it permits the use of a small relay operated with low currents.

This construction of a temperature switching device uses the actual heating element as the sensor and is therefore ideally coupled to its temperature. However, the invention also provides for other possibilities of a good coupling of a thermostat, in which the coupling to the heating means temperature is preferred in order to ensure a rapid, low-inertia response. It is e.g. possible to use a simple thermostat containing as the sensor a bimetal jump disk (KLIXON), which is more particularly applied in the overlap area 15 of the inner insulation 13. In this area will always be provided the "hot point" of the heating means and consequently a rapid response is ensured. The thermostat can be directly pressed onto the outer jacket 21 in this area. However, direct application to the external insulation 19 is also possible.

Another advantageous possibility of providing a temperature protection is constituted by the use of a temperature switch 36 (shown in broken line form in FIG. 2), which has a snap-action switch, which is operated by a reference bar 37 made from a material without any significant thermal expansion (e.g. ceramic), which is led outwards parallel to the heater axis 38 and at its end opposite to the switch 36 is fitted thereto. In this case the expansion of the heater, i.e. the hollow body 12 is used in order to produce the disconnection movement.

A further advantageous possibility for creating a temperature switching or regulating device consists of using a stainless steel capillary tube as the heating element in place of a heating tape. It is then wound onto the insulating film in corresponding manner to the heating element 17 and contains an expansion fluid, which is heated during the heating resulting from the flow through the capillary tube and acts on an expansion element, which can be used for disconnection and regulating functions.

FIGS. 10 to 13 show an excessive temperature protection device 50 in the form of a thermal-lag switch. It has an insulating material casing 51, which contains a base part 52, whose underside facing the flow heater 11 is shape-adapted thereto, i.e. an arcuate recess 53 with a radius corresponding to the hollow body external diameter.

From the base part 52 emanates a projection 54, to whose underside is fitted a thermal-lag switch 55. The latter comprises a bimetal 56, which is fixed on one side by means of a rivet 57 to the underside of the projection 54, while the other side of the bimetal 56 carries a switching contact 58, which cooperates with a corresponding opposite contact 59 on the underside of the projection 54. The bimetal 56 has a surge characteristic, i.e. through a domed shape it is constructed in such a way that it can assume two stable end positions between which there is a snap action.

Its outside is applied to the external insulation 19 of the heated area constructed as in the previous embodiments and is therefore almost directly coupled to the heating element 17, only the thin external insulation being interposed. In its central area particularly relevant for the snap action it receives direct contact heat from the heated area 16 and consequently has a particularly powerful and pronounced surge characteristic.

Figure 11:
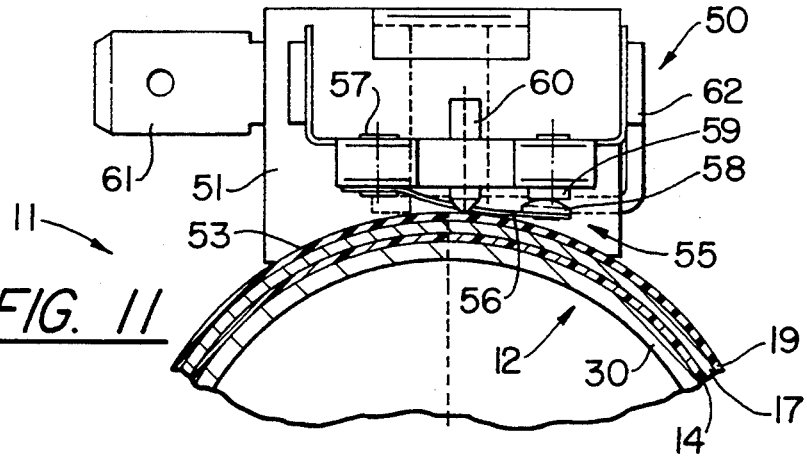
Figure 12:
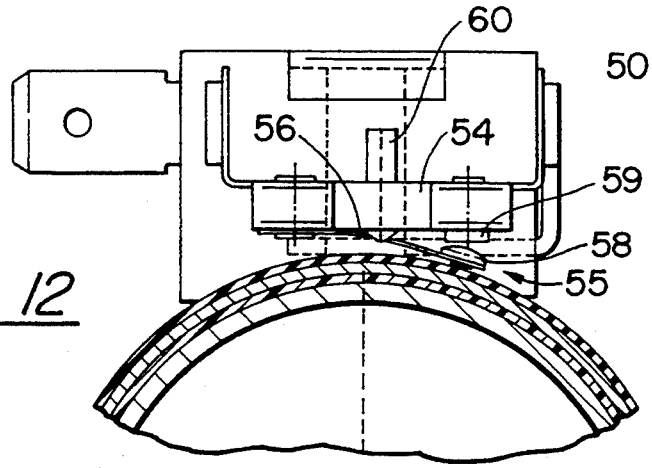
Figure 10:
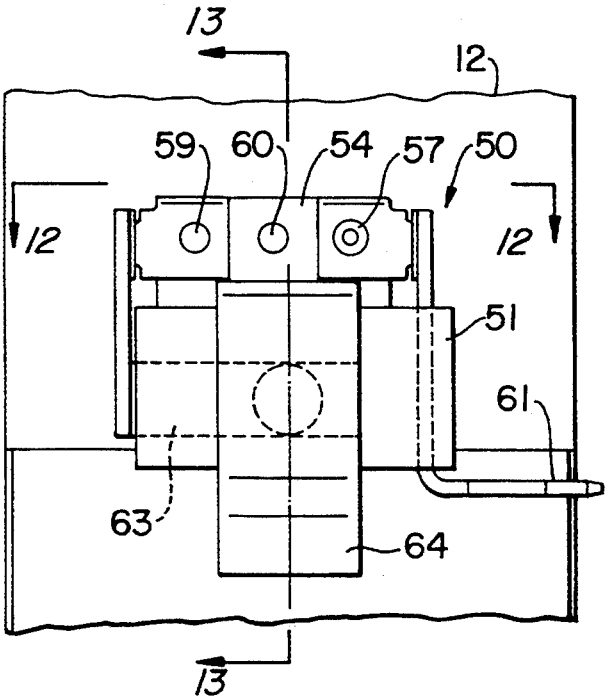
Figure 13:
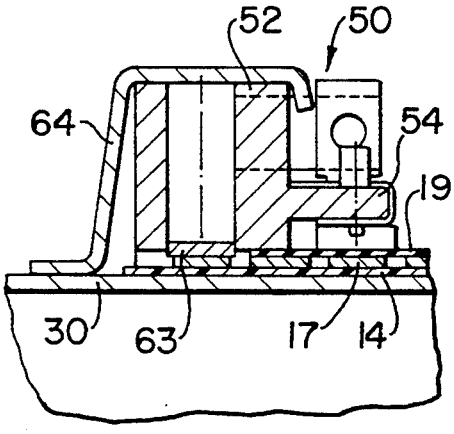

FIG. 11 shows that the bimetal 56 is substantially tangential to the hollow body 12, but with the curvature corresponding to its domed basic shape. As a result of the curvature of the hollow body 12 or the external insulation 19 in the vicinity of the switching contact 58 there is adequate free space for the opening of the switch in the case of the bimetal 56 jumping (FIG. 12).

Roughly in the center of the bimetal 56 engages a connecting pin 60, which is guided in an opening of the projection 54 and makes it possible, by pressure from above, to reconnect the switch 55, when it has been disconnected (FIG. 12), because the bimetal 56 would remain in its stable end position in the disconnected state. The bimetal switch 55 operates with live bimetal, i.e. the bimetal 56 is connected by means of the rivet 57 to a connection 61 in the form of a plain connector, while the opposing contact 59 is electrically connected to a clip 62, which has a substantially tangentially directed connecting tongue 63 (cf. FIG. 13), which can be directly welded to the heating element 17. The excess temperature protection device 5 consequently forms the connecting piece for one side of the heating element 17 and does not constitute a separately fitted part.

It is held in position by a retaining clip 64, which can be welded to the hollow body 12 outside the heated area.

Comprehensive testing has revealed that the conditions are particularly advantageous for a thermal coupling of an excess temperature protection element if the flow heater has in its heated area a power-related heat capacity not exceeding 0.04 s/K. The power-related heat capacity $m \times c/P$ is dimensioned from m (mass in kg), c (specific heat capacity in $kJ/(kg \times K)$ and P (power of the heating element in kW). If the said capacity is too high, although the switch responds on running dry, the excess heat could still damage the heating conductor.

The heated area, optionally also including the excess temperature protection device, could be enveloped, e.g. by a shrunk-on tube, which under heat action is firmly engaged round the unit.

According to the invention the preferably polyimide plastic film external insulation could also be of insulating paper, or a coating with a varnish or PTFE.

According to the invention the temperature protection device or thermostat can have a switch, whose contacts are irreversibly interrupted by an element which deforms and optionally melts under an excess temperature. Such a switch is e.g. known from DE-36 33 759 A1.

The wording of the claims is incorporated by reference into the description.

We claim:

1. An electric heater for media, comprising:

a tubular body having a wall with an inside surface and an outside surface;

at least one electric heating element heating a heated area applied to the outside of the wall;

a film-like electrical insulation disposed between the outside of the wall and the at least one heating element; and contact maintaining means for maintaining a contact of the at least one heating element to the wall outside surface by pretension of the at least one heating element creating an elasticity reserve of the at least one heating element relative to the wall despite a temperature-caused expansion difference in the area between the wall and the at least one heating element.

2. An electric heater for media, comprising:

a tubular body having a wall with an inside and an outside surface;

at least one electric heating element for heating a heated area applied to the outside of the wall; and a film-like electrical insulation disposed between the outside of the wall and the at least one heating element, the insulation including an un-reinforced plastic film being wound in at least one layer in overlapping manner onto the outside surface of the wall, the heating element including at least one flat tape of metallic resistance material, whose flat sides engage on the plastic film insulation, and being wound in uninsulated and unjacketed manner substantially directly and in helical manner onto the insulation.

3. A heater according to claim 2, wherein the film is made from a high temperature-resistant polyimide.

4. A heater according to claim 2, wherein the plastic film is in the form of a leaf passing in continuous manner over the heated area of the heater with an overlap along an axial generatrix of the wall.

5. A heater according to claim 2, wherein an adhesive is interposed between the heating element and the insulation.

6. A heater according to claim 2, wherein the thickness of the tape is smaller than 1/6 .

7. A heater according to claim 2, wherein over the heating element is placed an external insulation, which is constituted by a material chosen from a group of materials containing polyimide plastic film, insulating paper, a varnish coating and a polytetrafluoroethylene coating.

8. A heater according to claim 7, wherein an excess temperature protection device is provided, comprising a thermo switch with a shape adapted to that of the body and which contains a bimetal switch, whose bimetal is situated roughly tangential to the body in the connected state is in heat-transferring connection with the external insulation, in the heated area.

9. A heater according to claim 8, wherein the casing of the excess temperature protection device has a projection on a base, to whose underside is fixed one side of the live bimetal, the other side carries a switching contact.

10. A heater according to claim 2, wherein a metallic outer jacket is provided over the external insulation.

11. A heater according to claim 2, wherein in its connecting areas the heating element is reinforced by at least doubling of its material.

12. A heater according to claim 2, further comprising an excess temperature protection device.

13. A heater according to claim 12, the excess temperature protection device comprising a manually resettable reconnection barrier.

14. A heater according to claim 12, wherein the excess temperature protection device has contact means for substantially direct contacting of the heating element.

15. A heater according to claim 12, wherein the excess temperature protective device has a switch, whose contacts are irreversibly interrupted by an element

16. A heater according to claim 2, wherein an excess temperature protection device being coupled to an external insulation in the vicinity of an overlap of the insulation and is pressed onto an external insulation.

17. A heater according to claim 2, wherein the heating element is subdivided into at least two portions, which are interconnected by means of a solder melting at a given excess temperature, the solder being placed in an overlap area of the insulation between the wall and the heating element.

18. A heater according to claim 2, wherein a temperature switching device is operable through thermal expansion differences between the body and a reference part.

19. A heater according to claim 2, wherein the heating element comprises a hollow body, which is filled with an expansion fluid and acts by means of an expansion element of a temperature switching device on a switch.

20. A heater according to claim 2, wherein the heater in the heated area has a power-related heat capacity not exceeding $m \times c/P \leqq 0.04$ seconds/Kelvin and dropping below 0.01 seconds/Kelvin, m being the weight in kg, c the specific heat capacity in kJ/(kg×Kelvin) and P the power of the heating element in kW.

21. A heater according to claim 2, wherein the tubular body, has a protective jacket in the form of a shrunk-on tube.

22. An electric heater for media, comprising:

a tubular body having a wall with an inside and an outside surface;

at least one electric heating element for heating a heated area applied to the outside of the wall; and a film-like electrical insulation disposed between the outside of the wall and the heating element, said heating element including at least one connection piece fitted to the tubular body for connecting the heating element to an electrical power supply and further comprising an excess temperature protection device, being incorporated in the connection piece and operationally thermally but indirectly coupled to the heating element.

23. A heater according to claim 22, wherein the excess temperature protection device is in direct electrical and thermal contact with the heating element.

24. An electric heater for media, comprising:

a tubular body having a wall with an inside and an outside surface;

at least one electric heating element for heating a heated area applied to the outside of the wall;

a film-like electrical insulation disposed between the outside of the wall and the heating element, the heating element comprising at least one flat tape of metallic resistance material, whose flat sides engage on the insulation, the heating element being connected at at least one of its end portions with a connector having a curved portion to which the heating element has electrical and thermal contact for heat dissipation from the heating element at the at least one end portion, the thermal contact being maintained from a point where the heating element looses contact with the wall to an end of the heating element.

* * * * *

UNITED STATES PATENT AND TRADEMARK OFFICE

CERTIFICATE OF CORRECTION

PATENT NO. : 5,434,388

DATED : July 18, 1995

INVENTOR(S) : Kralik et al.

It is certified that error appears in the above-identified patent and that said Letters Patent is hereby corrected as shown below:

Column 10, line 16, after "and" insert --not--.

Signed and Sealed this

Fifth Day of March, 1996

Bruce Lehman

*Attest:*

BRUCE LEHMAN

*Attesting Officer*

*Commissioner of Patents and Trademarks*